US006093446A

United States Patent [19]

Bardeen

[11] Patent Number: 6,093,446

[45] Date of Patent: Jul. 25, 2000

[54] METHOD FOR DECORATING SURFACES WITH TRANSFER PATTERNS

[75] Inventor: Kea Bardeen, Denver, Colo.

[73] Assignee: Pumpkin Ltd., Denver, Colo.

[21] Appl. No.: 08/182,409

[22] Filed: Jan. 14, 1994

[51] Int. Cl.[7] ..... B41M 3/12

[52] U.S. Cl. ..... 427/146; 427/147; 156/57; 156/240; 426/383

[58] Field of Search ..... 427/146, 147; 428/79, 914; 156/57, 240; 206/457, 223, 575; 426/383, 87, 104

[56] References Cited

U.S. PATENT DOCUMENTS

| | | | |
|---|---|---|---|
| 4,024,287 | 5/1977 | Golchert | 426/383 |
| 4,058,644 | 11/1977 | DeVries et al. | 428/200 |
| 4,155,886 | 5/1979 | DeGoler | 260/17.4 R |
| 4,169,169 | 9/1979 | Kitabatake | 427/149 |
| 4,285,978 | 8/1981 | Quinlivan | 426/87 |
| 4,490,410 | 12/1984 | Takiyama et al. | 427/44 |
| 4,826,807 | 5/1989 | Shimomura et al. | 503/226 |
| 5,091,833 | 2/1992 | Paniaguas et al. | 362/191 |
| 5,162,138 | 11/1992 | Caflisch et al. | 428/17 |

OTHER PUBLICATIONS

Quickie Cake Transfers. 1970–71.

*Primary Examiner*—Brian K. Talbot

*Attorney, Agent, or Firm*—Timothy J. Martin; Michael R. Henson; Mark H. Weygandt

[57] ABSTRACT

The present invention provides a method of decorating a surface of an item that has an area adapted to display a design. The method comprises spreading onto the area a quantity of a viscous surface preparatory composition that has an initial first state that allows it to be spread onto the surface and is curable to a final state that forms a stable layer adhered to the surface. A pattern sheet is provided with the pattern formed thereon in a medium that will transfer onto the surface of the preparatory composition when in the initial state. The preparatory layer is contacted with the pattern sheet and the pattern thereon for a sufficient time to allow the medium to transfer onto the preparatory layer. After the transfer pattern has been transferred thereon yet before the preparatory layer has cured into the final state, the pattern sheet is removed from contact with the viscous preparatory layer. The preparatory layer is then cured into the final state thereby fixing the transferred pattern. The surface preparatory composition may include a solvent carrier base material, which is preferably water-based. The step of curing may be accomplished by drying the preparatory composition. A decorative substance may be applied onto the stable layer, such as in a manner corresponding to the design elements appearing on the transferred pattern. The pattern may be drawn onto the transfer sheet in the medium or the transfer sheet may be pre-printed with the pattern in the medium.

16 Claims, 2 Drawing Sheets

METHOD FOR DECORATING SURFACES WITH TRANSFER PATTERNS

FIELD OF THE INVENTION

The present invention is directed to a method and a kit for decorating a surface. Particularly, the present invention is directed to a method and kit for transferring a pattern onto the surface to be decorated after which the pattern may be colored to present a decorative appearance. Specifically, the present invention is directed to a method and kit for decorating surfaces of large vegetables or produce, such as pumpkins, with holiday themes.

BACKGROUND OF THE INVENTION

The provision of decorative designs on exposed surfaces has been known since the earliest cavemen first scratched or painted animal sketches on the walls of their dwellings. As is well-known, a variety of techniques are available for decorating surfaces, including printing, painting, carving, stenciling, etc. The present invention, however, is directed to the transferring of patterns onto a surface in a new and useful manner that may be particularly implemented by children. Even specifically, the present invention concerns decorating items of produced, such as pumpkins, in order to provide a decorative holiday theme. Of particular concern is providing a method and a kit for decorating pumpkins for halloween.

As is known, pumpkin carving has long been one of the several ways in which halloween is celebrated. Traditionally, pumpkin carving involves the removal of a portion of the pumpkin shell surrounding the stem, removal of the seeds and fibers contained in the pumpkin and thereafter carving humorous, grotesque or other decorative features partially or wholly through the pumpkin shell by removing fleshy portions of the shell to obtain the desired appearance. Internal illumination is then provided either by a candle or a battery operated light to result in a glowing decorative pattern.

In the past, pumpkin carving was typically accomplished with the use of pocketknives, paring knives, and the like. Due to the size of these cutting instruments, a typical carver was only able to obtain limited, fairly large-scaled decorative features. These knives can be quite difficult to control, and this, in conjunction with the sharpness of the knife, exposes the carver to the danger of injury. The result is that pumpkin carving exhibits a fairly high degree of danger for young children so that pumpkin carving was often done by an adult parent or older sibling. This, of course, reduces the enjoyment to the younger child from the pumpkin carving festivity.

In order to meet the need for safer instruments that might be utilized to carve decorative appearances in pumpkin shells, a pumpkin carving kit was developed and was described in U.S. Pat. No. 4,828,114 issued May 9, 1989 to John P. Bardeen. This pumpkin carving kit allows more intricate designs to be carved in the pumpkin shell and increases the safety over normal, pre-existing carving techniques for children, adults and the like. While this pumpkin carving kit exhibited a superior solution in response to the desire to carve pumpkins, there remained a need for safe pumpkin decorating techniques available to even younger children or as an alternative to pumpkin carving.

Other techniques have been known in the past to decorate pumpkins, and a primary example is the placing of decorative stickers on the pumpkin shell. Here, for example, decorative elements such as eyes, ears, noses, mouths and teeth are configured out of brightly colored paper-like material that is provided with an adhesive backing. The user simply selects the desired features and sticks each feature at a desired location on the pumpkin shell. While this both provides enjoyment for a small child and is safe, it fairly limits the festive event since very little time is involved in applying the stickers to the pumpkin shell.

Accordingly, there remains a need for improved surface decorating techniques that may be specially employed by children. These techniques need to be safe and easy to implement while providing increased enjoyment for the decorating experience. Moreover, there remains a need for an improved method and kit, especially usable by children, that may be employed in the decorating of pumpkins for halloween.

SUMMARY OF THE INVENTION

It is an object of the present invention to provide a new and useful method and kit adapted to decorate exposed surfaces in general, but specifically the exposed surface on the shell of an item of produce, such as a pumpkin.

Another object of the present invention is to provide a safe method and kit that may be employed by children to decorate surfaces, such as the exposed surface of a pumpkin.

Yet another object of the present invention is to provide a method and kit therefore wherein relatively dramatic and highly colorful designs may be placed on an exposed surface area, especially by a relatively young child.

Still a further object of the present invention is to provide a product that may be quickly predecorated by a new and useful method so that the product may be sold fully decorated, especially for a holiday occasion.

Another object of the present invention is to provide a pumpkin decorating method and kit therefor which allows a small child to easily and safely decorate a pumpkin for halloween while still requiring sufficient effort by the child to increase the time of the decorating festivity.

According to the present invention, then, a method is provided for decorating a surface of an item with a design wherein the item has an area adapted to display the design. Broadly, this method includes a first step of covering the area with a surface preparatory composition that has an initial first state that allows it to be spread on the surface of the item as a preparatory layer. Next, a pattern sheet is contacted with the preparatory layer, while the preparatory layer is still in the first state. This pattern sheet is provided to have a pattern formed thereon in a medium that will transfer onto the surface preparatory composition when it is in the initial state. The pattern sheet is contacted with the preparatory layer for a sufficient time to allow the medium forming the pattern to transfer onto the preparatory layer as a transferred pattern.

With greater specificity, the surface preparatory composition is one which cures or is curable alone or by the application of a curing material, and the method includes the step of curing the preparatory layer into a final state thereby fixing the transferred pattern on the stable layer. The transferred pattern can either be the completed decorative design, or, alternatively, the stable layer may be further colored or painted to bring out the decorative design features of the pattern, much in the manner of a coloring book. The broad method includes the step of removing the pattern sheet from contact with the preparatory layer after the transferred pattern has been transferred thereon yet before the preparatory layer has cured such that the pattern sheet does not become adhered to the surface.

The surface preparatory composition is selected to be one that includes a solvent carrier base, and it is preferred that this solvent carrier be water-based. In either event, the medium is selected to be soluble in the base material. Where the solvent carrier is water-based, the medium used to form the pattern should also be water-based. Here, the pattern sheet may be: (1) pre-printed with a pattern formed by the selected medium; (2) pre-printed with indelible pattern which is then traced with the selected medium so that the pattern may be transferred onto the preparatory layer; (3) pre-printed as a completed decorative design in the selected medium so that it is ready for transfer; or (4) blank, and the user draws the desired pattern or decorative design onto the pattern sheet;. It is preferred that the initial state of the preparatory composition be a wetted state and that the final state be a dried state. Here, the step of curing the preparatory layer is accomplished by allowing it to dry into the stable layer. After drying, the design elements of the pattern may be further decorated, such as by applying a decorative substance such as paint, crayon, colored marker or the like to increase the aesthetic effect of the overall design.

As noted above, it is preferred that the preparatory composition is based on a water or other solvent. However, the preparatory composition should be nontoxic to humans. Moreover, it should be sufficient viscous so as to resist flowing even when placed in a vertical condition such as on the surface of a pumpkin shell. A suitable preparatory composition may be one selected from a group consisting of: glues (both animal and non-animal), pastes and egg white.

While the invention includes products made by these methods, the present invention may readily marketed as a kit which contains the necessary elements for practicing the above described method. Here, the kit includes a surface preparatory composition of the type described above, at least one pattern sheet that is either: (1) pre-printed with a medium that will transfer onto the surface preparatory composition; or (2) pre-printed with an indelible design that may be traced that will transfer onto the preparatory composition; (3) pre-printed with a completed design in the selected medium; or (4) blank. The kit may also includes a pattern forming medium that may be placed on the pattern sheet wherein the pattern forming medium is one of a type that will transfer onto the surface preparatory composition with the surface preparatory composition is spread into an initial layer that can then cure into a final layer that will fix the pattern onto the surface to be covered. This kit may include a plurality of pattern sheets pre-printed with different patterns either in indelible ink or in the selected medium. A plurality of decorative marks, such as crayons, paints or marking pens of different colors may be provided with the kit, as well.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention concerns a method of decorating an exposed surface area with a decorative design, and includes both a decorated product decorated and a kit of items necessary to practice this method. While the present invention is described with respect to the decorating of items of produce, such as a pumpkin for halloween, it is to be understood that, in its broadest form, the present invention could be employed to decorate other surfaces, as well, so that the scope of this patent is not be to limited by the fact that it is described with respect to the decorating of pumpkins.

Figure 1:
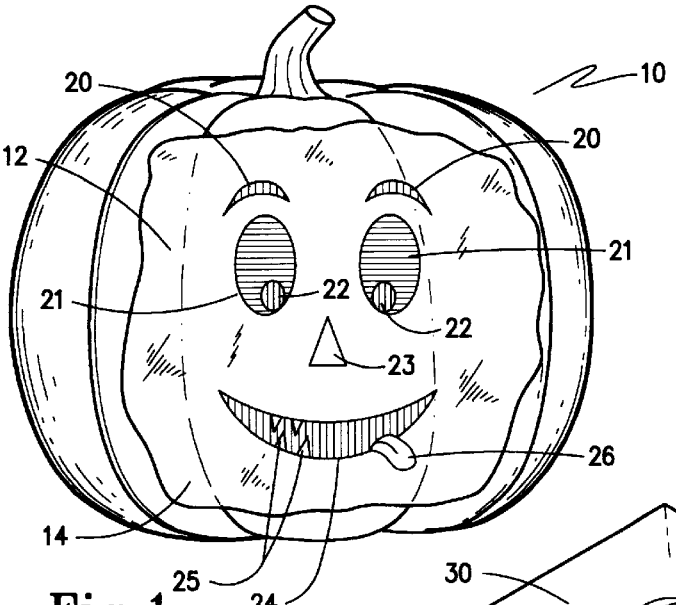
FIG. 1 is a perspective view of surface in the form of pumpkin decorated according to the present invention.

As may be seen in reference to FIG. 1, then, a decorated product in the form of decorated pumpkin 10 is shown in its completed form. Here, it may be seen that decorated pumpkin 10 has a design 12 affixed thereon by means of a preparatory layer 14 which has been cured into the final state shown in FIG. 1. Design 12 includes a plurality of design elements, such as a pair of eye brows 20, eyes 21 (provided with pupils 22), nose 23, mouth 24 (provided with teeth 25) and tongue 26. As may be seen in FIG. 1, the different design elements 20–26 have been painted to present a more dramatic effect than merely the outline of the design elements. The method of forming decorated pumpkin 10 may best be appreciated with references to FIGS. 2–5, below.

Figure 2:
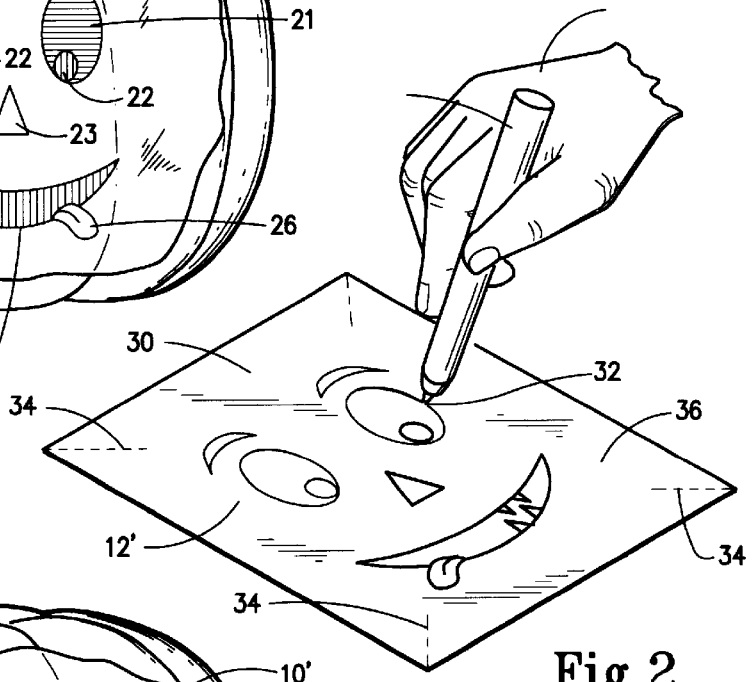
FIG. 2 is a perspective view of a pattern sheet according to the preferred embodiment of the present invention and showing a user tracing an indelible with a transfer medium.

Turning to FIG. 2, it may be seen that a pattern sheet 30 is employed and, in this Figure, pattern sheet 30 is pre-printed with a design 12' that is the mirror image of the resulting design 12 on decorated pumpkin 10. Preferably, design 12' is printed in a transfer medium, as discussed below, but in FIG. 2, it may be seen that alternatively the pattern 12' may be printed with an indelible ink. Here, the hand 16 of user is manipulating marker 18 to trace the outline of the design elements of design 12' with a medium 32. It may be seen in FIG. 2 that the user has already traced the nose, mouth, teeth and tongue elements and is starting to trace one of the eye elements of design 12'. Pattern sheet 30 includes a plurality of cut lines 34 provided at each corner so that the pattern may be severed a portion of the distance of each corner towards the center of pattern sheet 30 which allows pattern sheet 30 to be placed around the generally spherical contour of the pumpkin to be decorated.

Figure 3:
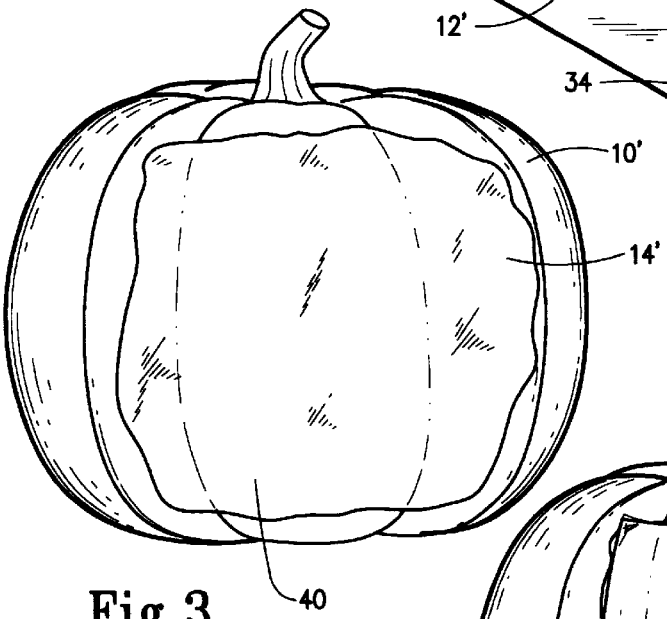
FIG. 3 is a perspective view showing a pumpkin having a surface area thereof coated with a preparatory layer according to the present invention.
Figure 4:
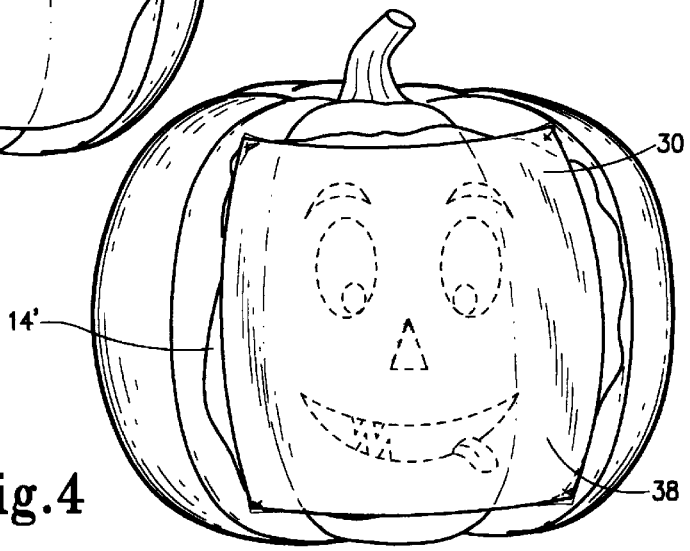
FIG. 4 is a perspective view of the pumpkin of FIG. 3 having the pattern sheet of FIG. 2 contacting the preparatory layer thereof.
Figure 5:
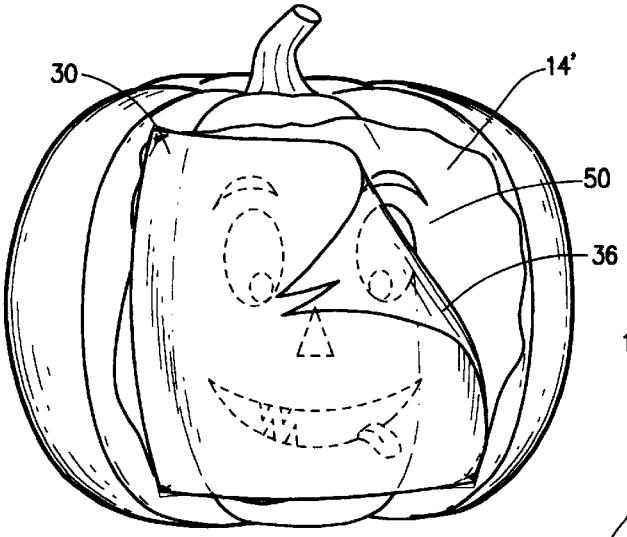
FIG. 5 is a perspective view of the pumpkin of FIG. 4 with the pattern sheet of FIG. 2 partially pulled away therefrom to expose the preparatory layer with the pattern transferred thereonto.

With reference to FIGS. 3, 4 and 5, it may be seen that the pumpkin 10 has a surface area thereof coated with a surface preparatory composition 40 to form a preparatory layer 14' that, in FIG. 3, is shown to be in an initial state. In the initial state, the preparatory composition 40 is such that it maybe spread onto the surface area of undecorated pumpkin 10'. In the initial state, surface preparatory composition 40 and, more specifically, preparatory layer 14' (in the initial state) is such to receive transfer of medium 32 so that regardless of whether pattern 12' is printed with medium 32 or is traced with medium 32, when pattern 12' contacts preparatory layer 14' in the initial state, the pattern image will be transferred onto preparatory layer 14' after a sufficient time prior to the curing of preparatory layer 14' into the stable layer 14 shown in FIG. 1. For this reason, when design 12' is traced with medium 32, it is preferred that tracing be done contemporaneously with the covering of the area of undecorated pumpkin 10 with preparatory layer 14' either immediately before or after the forming of layer 14'.

The transference of the pattern is best shown in FIGS. 4 and 5. In FIG. 4, it may be seen that pattern sheet 30 has been severed along cut lines 34 so that front surface 36 may be pressed against preparatory layer 14 which is still in the initial state. As is shown in phantom, the design elements of design 12' contact the preparatory layer 14' with the back surface 38 of pattern sheet 30 being exposed. Back surface 38 of pattern sheet 30 may be lightly rubbed or smoothed to facilitate the transfer of the pattern that is provided with the medium 32. With reference to FIG. 5, it may be seen that, after a sufficient time has elapsed, and preferably before preparatory layer 14' has cured, pattern sheet 30 is peeled off of preparatory layer 14' to reveal transferred pattern 50 thereunder. To this end, it should now be appreciated that medium 32 must be of a type that will transfer into the uncured preparatory composition forming a layer 14'. For example, the preparatory composition may include a solvent component, such as water or other solvent carrier base material and medium 32 includes a component that is soluble in this solvent base carrier material.

After completely removing pattern sheet 30 from the preparatory layer 14', it is allowed to cure into the stable state as preparatory layer 14 shown in FIG. 1. Where only a pattern is transferred, the various design elements, such as design elements 20–26 may now be colored in by any suitable means, but preferably they are painted with brightly colored, opaque paints. Painting is preferred since the intensity of the orange of a pumpkin requires a strongly pigmented coloring material so that a dramatic design appearance may be presented.

From the foregoing, it should now be appreciated that the method according to the present invention contemplates a method of decorating the surface of an item that has an area adapted to display a design by covering the area with a surface preparatory composition that has an initial state that allows it to be spread onto the surface of the item as a preparatory layer. The preferred method of the present invention next contemplates the transference of a pattern onto the preparatory layer while in the initial state. However, it should be fully appreciated that it is within the scope of this invention that an entire decorative design, in completed form, be transferred rather than just an outlined pattern. In the preferred method, then, the step of transferring the pattern is accomplished by providing a pattern sheet with a pattern formed thereon and a medium that will transfer onto the surface preparatory composition when the surface preparatory composition is in the initial state and contacting the preparatory layer with the pattern sheet and the pattern thereon for sufficient time to allow the medium to transfer onto the preparatory layer whereby a transferred pattern transfer onto the preparatory layer.

The method may also include the step of curing the preparatory layer after the pattern is transferred and/or the step of removing the pattern sheet is removed from the preparatory layer, preferably while the preparatory layer is still in the initial state. Curing can either be accomplished by allowing the preparatory composition to cure on its own or otherwise contacting the preparatory layer with a material that cures it into a stable state. Where a pattern is transferred, the method includes the step of applying a decorative substance in a manner corresponding to the design elements appearing on the transferred pattern.

The preparatory composition may be any of a wide variety of materials but it is preferred that the selected materials be nontoxic to humans or other animals. Accordingly, while various solvent based compositions are contemplated by this invention, it is preferred that the preparatory composition be water-based. The preferred material is a product sold under the trademark name "STICK-IT" by Plaid Enterprises. However, almost any type of adhesive-type material or glue may work, but it is desirable that it be sufficiently viscous so that it will not be runny when applied to the surface of the item to be decorated. Accordingly, it should be suitable viscous so as to resist flow when the surface upon which it is applied is placed in an upright orientation while the preparatory composition is still in the initial state. Indeed, a tacky substance is desirable and, where the tacky substance does not cure to a completely dry final state, curing can include the treatment of the substance with a hardener or a coating, such as a clear latex.

Since it is desirable that the pattern readily transfer onto the preparatory layer, the transfer medium 32 could be selected to cooperate with the solvent base to accomplish this transference. Where a stick glue like the STICK-IT product sold by Plaid Enterprises is selected, a suitable water-based marker material could be used. Indeed, in the preferred form of the present invention, the pattern is pre-printed onto the pattern sheet in a water-based marker-type ink that is soluble in the selected preparatory composition so that the user simply contacts the pre-printed pattern with the preparatory layer 14' to obtain transference. This avoids the necessity of tracing the pattern, for example, with a water-based marker. It should be understood, however, that the user can create his/her own design on a blank sheet of paper with a suitable pattern medium or even completely color the design elements on the pattern sheet with the medium so that either his/her own pattern or the completed design be transferred when the preparatory layer 14' is contacted.

From the above description, it should now be understood and appreciated that the present invention contemplates a completed product of the type created by the steps described above and according to the appended claims. Moreover, the present invention contemplates the packaging of a group of materials suitable to practice these methods in a kit form. Here, the kit includes a surface preparatory composition that has a first initial state that allows it to spread onto the surface of an item to be decorated as a preparatory layer yet which may cure or be cured into a final state to form a stable layer adhered to the surface. The kit also includes a pattern sheet and a pattern forming medium that is adapted to be placed on the pattern sheet in a selected pattern with this medium being of a type that will transfer onto the surface preparatory composition when in the initial state. The pattern state can be pre-printed with the pattern forming medium or the pattern forming medium can be supplied in a form that the user may trace a pre-printed drawn pattern or draw his/her own pattern on the pattern sheet. A plurality of containers of paint having different colors may be included with the kit so that decorative design elements may be painted upon the final product.

Figure 6:
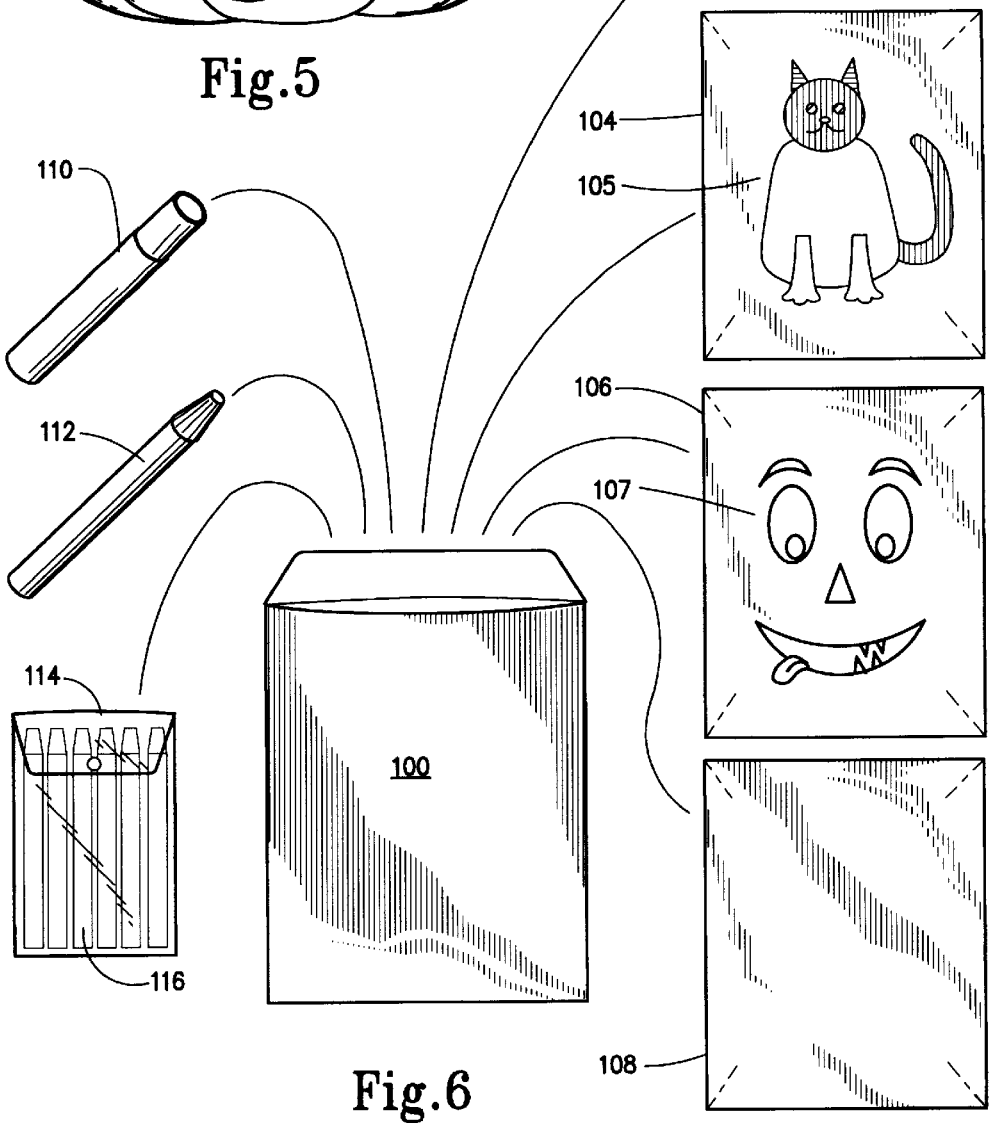
FIG. 6 shows an exemplary embodiment of a kit according to the present invention showing four different types of pattern sheets.

Accordingly, as is shown in FIG. 6 for representation purposes, a kit according to the present invention may readily include a package 100 in the form of an envelope, blister pack or other suitable marketing container which is adapted to receive one or more patterns sheets 102, 104, 106 and 108. Container 100 may also receive a tube 110 of surface preparatory material, as described above, along with a marker 112 containing medium 32, described above, and a small package 114 containing a plurality of paints 116.

With reference to FIG. 6, it should be understood that pattern sheet 102 contains a design 103 which is pre-printed with medium 32 so as to be compatible with the surface preparatory composition contained in container 110. Similarly, pattern sheet 104 includes a pattern 105 (in the form of colored cat) which has been completely colored by various colored medium similar to medium 32 that is compatible with the surface preparatory composition 110. Pattern sheet 106 is provided with a design 107 that is printed in an indelible ink which may be traced by the medium 32 contained in marker 112. Finally, pattern sheet 108 is blank so that it may be drawn upon by marker 112 to create an original pattern for transference onto the surface to be decorated. It should be understood, however, that if only pattern sheets of the type of pattern sheets 102 and/or 104 are included, then marker 112 may be eliminated from the kit. Moreover, in its most general form, the kit can eliminate packet 114 of paints 116; however, this would necessitate that the user acquire his/her own pigment paints to complete the design unless, of course, only pattern sheet 104 were included in the kit.

Accordingly, the present invention has been described with some degree of particularity directed to the exemplary embodiments of the present invention. It should be appreciated, though, that the present invention is defined by the following claims construed in light of the prior art so that modifications or changes may be made to the preferred exemplary embodiment of the present invention without departing from the inventive concepts contained herein.

I claim:

1. A method of decorating a surface of an item that has an area adapted to display a design, comprising the steps of:

(a) spreading a quantity of a viscous surface preparatory composition onto the area so as to cover the area with a viscous preparatory layer wherein said surface preparatory composition has an initial first state that allows it to be spread onto the surface of the item as the viscous preparatory layer and wherein said surface preparatory composition is curable to a final state that forms a stable layer adhered to the surface;

(b) providing a pattern sheet with the pattern formed thereon in a medium that will transfer onto said surface preparatory composition when in the initial state;

(c) contacting said preparatory layer with said pattern sheet and the pattern sheet thereon for a sufficient time to allow said medium to transfer onto said preparatory layer where a transferred pattern transfers onto said preparatory layer;

(d) removing said pattern sheet from contact with said viscous preparatory layer after the transferred pattern has been transferred thereon yet before said preparatory layer has cured into the final state; and (e) curing said preparatory layer into the final state thereby fixing the transferred pattern.

2. A method according to claim 1 wherein said surface preparatory composition includes a solvent carrier base material.

3. A method according to claim 2 wherein said solvent carrier is water based.

4. A method according to claim 1 wherein the initial state of said preparatory composition is a wetted state and the final state of said preparatory composition is a dried state, the step of curing said wet layer being accomplished by allowing said preparatory layer to dry into said stable layer.

5. A method according to claim 1 including the step of applying a decorative substance onto said stable layer.

6. A method according to claim 5 wherein the transferred pattern includes a plurality of design elements and wherein said decorative substance is applied in a manner corresponding to the design elements appearing on the transferred pattern.

7. A method according to claim 1 wherein the step of providing the pattern sheet is accomplished by providing a transfer sheet and by drawing the pattern on said transfer sheet in said medium at a time relatively contemporaneously with the step of covering the area with said surface preparatory composition.

8. A method according to claim 7 wherein said transfer sheet is printed with a preprinted pattern, the step of drawing the pattern on said transfer sheet being accomplished by tracing the preprinted pattern with said medium.

9. A method according to claim 1 wherein the step of providing the pattern sheet is accomplished by providing a transfer sheet that is pre-printed with the pattern in said medium.

10. A method according to claim 1 wherein said surface preparatory composition is nontoxic to humans.

11. A method according to claim 1 wherein said surface preparatory composition is water based.

12. A method of decorating a surface of an item of produce that has an area of sufficient size to display a design, comprising the steps of:

(a) providing a pattern sheet with the pattern pre-printed thereon in a water soluble medium;

(b) covering the area with a water-based surface preparatory composition that has an initial first state that allows it to be spread onto the surface of the item as a viscous preparatory layer yet which cures into a final state to form a stably layer adhered to the surface, said selected medium being selected as one that will transfer onto said surface preparatory composition when int he initial state;

(c) contacting said preparatory layer with said pattern sheet for a sufficient time to allow said medium to transfer onto said preparatory layer whereby a transferred pattern transfers onto said preparatory layer and thereafter removing said pattern sheet within a time insufficient to allow said pattern sheet to become affixed to said item of produce; and (d) allowing said preparatory layer to cure into said final state thereby fixing the transferred pattern on said stable layer.

13. A method according to claim 12 wherein the initial state of said preparatory composition is a wetted state and the final state of said preparatory composition is a dried state, the step of curing said wet layer being accomplished by allowing said preparatory layer to dry into said stable layer.

14. A method according to claim 12 including the step of painting portions of the pattern on said stable layer.

15. A method of decorating a surface of an item that has an area adapted to display a design, comprising the steps of:

(a) covering the area with a surface preparatory composition that has an initial first state that is sufficiently viscous to allow it to be spread onto the surface of the item as a preparatory layer, said surface preparatory composition being selected from a group consisting of: water-based non-animal glues, water-based animal glues, water-based pastes and egg white;

(b) providing a pattern sheet with the pattern formed thereon in a medium that will transfer onto said surface preparatory composition when in the initial state; and (c) contacting said preparatory layer with said pattern sheet and the pattern thereon for a sufficient time to allow said medium to transfer onto said preparatory layer where a transferred pattern transfers onto said preparatory layer.

16. A method according to claim 15 wherein said surface preparatory composition is a stick glue.

* * * * *